US006092284A

United States Patent [19]

Dreiman et al.

[11] Patent Number: 6,092,284

[45] Date of Patent: Jul. 25, 2000

[54] SUCTION ACCUMULATOR ASSEMBLY

[75] Inventors: Nelik I. Dreiman, Tipton; Rick L. Bunch, Tecumseh; Tara C. Kandpal, deceased, late of Tecumseh, all of Mich., by Geeta Kandpal, executrix

[73] Assignee: Tecumseh Products Company, Tecumseh, Mich.

[21] Appl. No.: 09/188,666

[22] Filed: Nov. 9, 1998

Related U.S. Application Data

[62] Division of application No. 08/747,889, Nov. 13, 1996, Pat. No. 5,850,743.

[51] Int. Cl.[7] ..... B23P 15/00

[52] U.S. Cl. ..... 29/890.02; 29/890.043; 29/890.053

[58] Field of Search ..... 29/890.02, 890.043, 29/890.054, 428; 62/503

[56] References Cited

U.S. PATENT DOCUMENTS

| | | | |
|---|---|---|---|
| 2,050,942 | 8/1936 | Francis | 29/148.2 |
| 2,086,541 | 7/1937 | Dodelin | 285/56 |
| 2,200,162 | 5/1940 | De Vulitch | 29/148.2 |
| 2,372,800 | 4/1945 | Stearns | 220/3 |
| 2,376,831 | 5/1945 | Stearns | 220/3 |
| 2,813,664 | 11/1957 | Punte | 222/566 |
| 2,819,001 | 1/1958 | Pottle | 222/566 |
| 2,859,892 | 11/1958 | Daley | 220/3 |
| 3,061,338 | 10/1962 | Clark | 285/202 |
| 3,488,678 | 1/1970 | Wagner | 62/503 |
| 4,004,709 | 1/1977 | Simkus | 220/257 |
| 4,045,861 | 9/1977 | Zahid | 29/454 |
| 4,589,563 | 5/1986 | Born | 220/3 |
| 4,607,503 | 8/1986 | Fry | 62/503 |
| 4,757,696 | 7/1988 | Gannaway | 62/503 |
| 4,888,962 | 12/1989 | Harper et al. | 62/503 |
| 5,177,982 | 1/1993 | Plemens | 62/503 |
| 5,507,159 | 4/1996 | Cooksey | 62/503 |

*Primary Examiner*—Irene Cuda
*Attorney, Agent, or Firm*—Baker & Daniels

[57] ABSTRACT

A suction accumulator for a refrigerant compressor which is mounted to the compressor in such a way as to reduce the metal fatigue at the joint between the inlet tube and the suction accumulator, and reduce the potential for rust or oxidation of the metal of the suction accumulator. The suction accumulator includes a cylindrical housing with two domed ends, wherein an inlet tube extends into the inlet of the suction accumulator and is provided with a flared end. The flared end is attached to the inlet of the suction accumulator and the flared end matches the contour of the inlet such that when the two parts are joined they are congruent with each other to thereby reduce the vibration therebetween. The suction accumulator is also provided with an outlet which communicates refrigerant from the suction accumulator back to the compressor. The suction accumulator is secured to the outside wall of the compressor using a mounting bracket. The mounting bracket is provided with a weld projection aperture and a plurality of weld projections which are used in welding the mounting bracket both to the suction accumulator and to the compressor. The mounting bracket is pre-assembled to the suction accumulator so that the accumulator and the mounting bracket can be mounted to a compressor as one integral unit.

6 Claims, 3 Drawing Sheets

SUCTION ACCUMULATOR ASSEMBLY

This is a division of application Ser. No. 08/747,889, filed Nov. 13, 1996, now U.S. Pat. No. 5,850.743.

BACKGROUND OF THE INVENTION

1. Field of the Invention

The present invention generally relates to refrigerant compressors, and more particularly relates to suction accumulators used in conjunction with refrigerant compressors.

2. Description of the Related Art

Air conditioning and refrigeration systems in use today include a compressor that compresses and superheats refrigerant vapor, which is then run through a condenser, expanded, and evaporated in turn before returning to the compressor to begin the cycle again. The output of the evaporator carries components of refrigerant and lubricating oil in a vapor-liquid mixture. In some cases, a suction accumulator is interposed between the evaporator and the compressor. Primarily, the accumulator receives and accumulates the gas-liquid mixture from the evaporator outlet and serves as a reservoir and separator in which liquid collects at the bottom and gas at the top.

The basic structure of a suction accumulator is typically a cylindrical reservoir formed from one or more portions and having top and bottom ends. The top end portion typically is manufactured from a material having superior plasticity characteristics, such as copper, and is most often convex or frusto-conical in shape. The top end portion also has an inlet aperture to accommodate an inlet tube, also typically made from copper, for the connection of the suction accumulator to the output conduit of the evaporator. The bottom end portion has an outlet aperture to accommodate a suction tube which is partially internal to the accumulator reservoir and has one end connected to the compressor and an open end located inside the accumulator reservoir, above the level of the liquid, so that the compressor draws primarily gas through the suction tube, Typically, a small bleed hole is located on the return suction tube to effect a suction pressure near the bottom end of the accumulator reservoir thereby aspirating the liquid accumulated therein.

Accumulators are typically mounted on the compressor housing. This reduces pressure drop in the connecting tubing, improves performance, and makes the refrigeration system compact and easy to manufacture. However, since the accumulator is mounted directly on the compressor housing, any vibration generated by the compressor can be transmitted to the accumulator. This vibration can stress the joints between the suction accumulator inlet and the evaporator output conduit and is sometimes sufficient to fatigue and damage the individual components. The maximum stress has been found near the input tube/top end input aperture joint and is a result of the combined load of the pressure pulsations and vibrations triggered by operation of the compressor and associated unit. The convex or frusto-conical shapes at the top end part of prior art suction accumulators were an effort to distribute the stress loads over a larger area and to prevent concentration of stress at the joint of the input suction tube and the inlet aperture at the top end part. Generally, such prior art convex or frusto-conical shaped top ends had to be manufactured from materials of superior plasticity, such as copper, to achieve the desired results.

One prior art arrangement for mounting accumulators in a refrigeration system is disclosed in U.S. Pat. No. 4,607,503, which shows an accumulator bracket disposed in the area between the accumulator casing and the compressor housing. While this bracket provides a reliable mount for the accumulator on the compressor, some vibration is transmitted to the accumulator. Moreover, this accumulator location permits use of the accumulator as a handle for the compressor during installation of the unit, which will sometimes result in damage to the return tubing.

Another prior art arrangement for mounting of accumulators is disclosed in U.S. Pat. No. 4,888,962, which is assigned to the assignee of the present invention and which discloses an accumulator assembly having strap means engaged with the compressor housing for holding the accumulator in closely spaced relationship with the housing. The strap means includes a spring loop formed thereon for resiliently varying the tension of the strap means so that the accumulator may be tightly held in close proximity to the compressor. Special self-tapping screws are necessary to tighten the accumulator strap and adjust its tension. This increases the total number of parts, time necessary for assembly of the accumulator, cost, and moreover, the metal area covered by the strap will not be painted beneath the strap.

SUMMARY OF THE INVENTION

The present invention overcomes the aforementioned problems by providing an accumulator design which is able to handle the vibrations generated by a compressor without fatigue or breakage. In the embodiment disclosed herein, the accumulator of the present invention includes a cylindrical reservoir with a top end and a bottom end. The reservoir may be formed from a single or multiple portions. A mounting bracket is welded, brazed, or otherwise attached to the reservoir, so that, after assembly, the mounting bracket is integral with the accumulator.

The present invention provides a suction accumulator that is configured optimally so as to minimize the stress experienced at the top end part. By minimizing the maximum stress level at the input tube/top end input aperture joint, the accumulator of the present invention may be manufactured from steel, a relatively non-plastic material. The use of steel in the manufacturing of the present invention suction accumulator results in an accumulator that is lighter in weight and less expensive to manufacture, as compared to a similar accumulator made of copper.

In comparing the finite element analysis of a copper suction accumulator with a steel suction accumulator of the same design, the Von-Mises stress near the suction inlet tube/top end input aperture joint of the steel accumulator is approximately 1.5 to 2 times higher than that of the copper accumulator. Because of this, accumulators of the prior art were generally made from copper. Experimental studies reveal that compressors equipped with steel accumulators of prior art design develop cracks at the base of extending flanges which accept suction inlet tubes, such as shown in U.S. Pat. Nos. 4,607,503 and 4,888,962. Such cracks in steel accumulators of prior art design result from steel fatigue under concentrated dynamic loads applied by the compressor and the associated unit.

The present invention includes an input tube, having a generally cylindrical tubular body with a proximal end portion for attachment to the evaporator of a refrigeration system, and a distal end portion for mounting to the input aperture of the accumulator top end portion. The proximal end portion of the inlet tube is located outside the accumulator and has an inwardly directed depression disposed thereon. The distal end portion of the input tube is located inside the accumulator and is flared. The flare is made at such an angle that the contour of the flare matches and follows the contour of the top end portion of the accumulator housing near the input aperture. During the assembly of the accumulator, the mating surfaces of the flared end and the accumulator housing are welded, brazed, or similarly attached, together.

One advantage of the present invention is that it provides an improved stable joint between the inlet tube and the suction accumulator.

Another advantage of the present invention, is that it provides greater access to surface areas for painting thereby avoiding potential oxidation and rust.

Further advantages of the present invention are reductions in the number of parts, the assembly cost, and the time required to produce the present invention.

The present invention, in one form thereof, provides a suction accumulator comprised of a housing, an inlet tube, a suction tube, and a mounting bracket. The housing includes an inlet and outlet. The housing inlet includes an outwardly directed annular neck, an annular arcuate portion, and an annular flange, with the annular arcuate portion being disposed between, and integral with, the neck and the flange. The inlet tube is disposed within the housing inlet and includes a flared outlet end and a tubular portion. The flared outlet end is sized and contoured to be congruent with the arcuate portion of the housing inlet, and the tubular portion is sized and contoured to be congruent with the neck of the housing inlet. The inlet tube and the housing inlet are attached together. The suction tube is disposed partially within the housing and the mounting bracket is secured to the housing and is adapted to be secured to the compressor.

The present invention also provides a compressor comprising a compressor housing, a compressor mechanism disposed within the compressor housing, a suction accumulator, an inlet tube, a suction tube, and a mounting bracket. The suction accumulator is in communication with the compressor mechanism, and includes a housing having an inlet and an outlet. The housing inlet includes an outwardly directed annular neck, an annular arcuate portion, and an annular flange, with the annular arcuate portion being disposed between, and integral with, the neck and the flange. The inlet tube is disposed within the housing inlet and includes a flared outlet end and a tubular portion. The flared outlet end is sized and contoured to be congruent with the arcuate portion of the housing inlet, and the tubular portion is sized and contoured to be congruent with the neck of the housing inlet. The inlet tube and the housing inlet are attached together. The suction tube is disposed between the accumulator outlet and the compressor mechanism for conveying fluid therebetween. The mounting bracket secures the accumulator to the compressor housing.

The present invention, in another form thereof, provides a method for manufacturing a suction accumulator and compressor assembly, comprising the steps of securing a mounting bracket to a suction accumulator housing and then attaching the mounting bracket to a compressor. The suction accumulator housing has an inlet and an outlet, with an inlet tube disposed within the inlet and a suction tube disposed within the outlet. The mounting bracket, suction accumulator, inlet tube and suction tube form one unit and are attached to the compressor as one unit to thereby reduce the assembly time required for the suction accumulator and compressor assembly.

BRIEF DESCRIPTION OF THE DRAWINGS

The above mentioned and other features and advantages of this invention, and the manner of attaining them, will become more apparent and the invention will be better understood by reference to the following description of an embodiment of the invention taken in conjunction with the accompanying drawings wherein.

Corresponding reference characters indicate corresponding parts throughout the several views. The exemplification set out herein illustrates one embodiment of the invention, and such exemplification is not to be construed as limiting the scope of the invention in any manner.

DETAILED DESCRIPTION OF THE INVENTION

Figure 1:
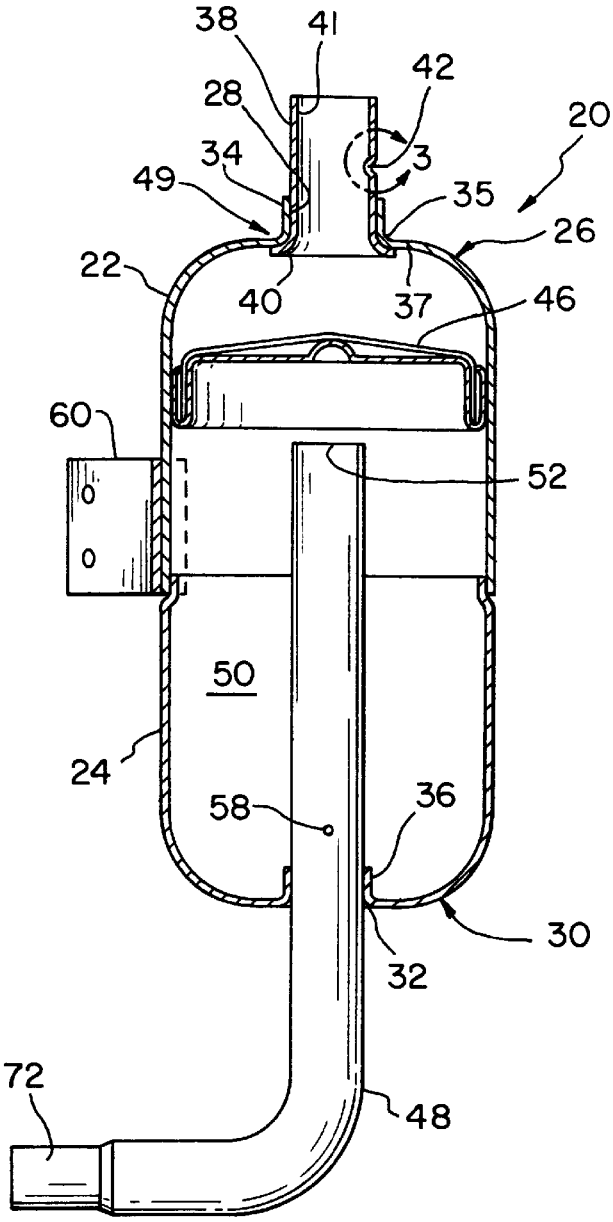
FIG. 1 is a longitudinal sectional view of the present invention.
Figure 7:
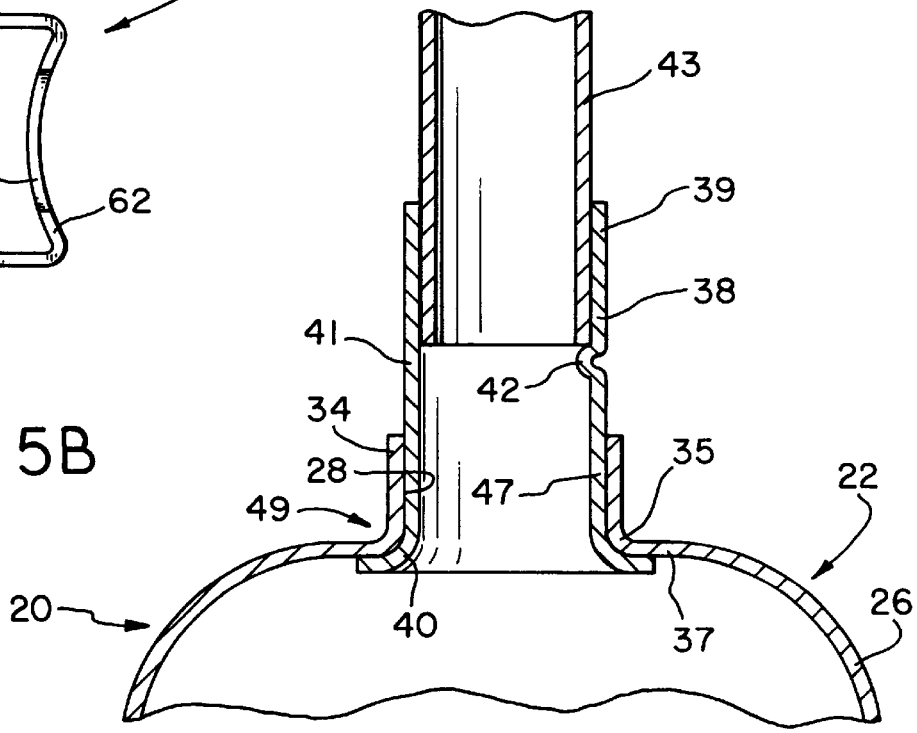
FIG. 7 is an enlarged fragmentary sectional view of the top end of the suction accumulator, the inlet tube, and an evaporator conduit.

Referring now to the drawings and particularly to FIG. 1, suction accumulator 20 is shown having top portion 22 and bottom portion 24. Top portion 22 is provided with domed end 26 and inlet 28, while bottom portion 24 is provided with domed end 30 and outlet 32. Inlet 28 is provided with an outwardly directed neck 34, and outlet 32 is provided with an inwardly directed neck 36. As best shown in FIG. 7, inlet 28 also includes arcuate portion 35 and flange portion 37. Arcuate portion 35 is integral with neck 34 and flange 37, and flange 37 is integral with top domed end 26.

FIG. 7 also shows suction inlet tube 38 disposed within accumulator inlet 28.

Inlet tube 38 includes tubular portion 41 having proximal end portion 39 and distal end portion 47 which is attached to the accumulator at inlet 28. Distal end portion 47 is sized and contoured to be congruent with neck 34 of housing inlet 28 and includes flared end 40, which is sized and contoured to be congruent with arcuate portion 35 of housing inlet 28. Proximal end portion 39 is located outside the accumulator and is attached to evaporator output conduit 43 of a refrigeration or air conditioning system. In the exemplary embodiment, inlet tube 38 is manufactured from copper and is brazed to the accumulator at inlet 28. However, other materials having similar plasticity characteristics and other fastening techniques such as welding are possible. The resulting three - layer construction provides a reinforced structure at joint 49 of the top-end and the input tube which resists cracking.

The maximum stress levels near suction input tube/top end joint 49 are listed in the following table (the values shown were arrived at via finite element analysis):

| MODIFICATION | MAX. STRESS AT TOP JOINT, PSI |
|---|---|
| COPPER ACCUMULATOR, STRAIGHT TUBE | 15000 |
| STEEL ACCUMULATOR, STRAIGHT TUBE | 22000 |
| STEEL ACCUMULATOR, FLARED TUBE | 14000 |

The suction accumulator configuration of the present invention results in a 36% reduction in the predicted stress level experienced at joint 49. The reduction in the predicted stress levels at joint 49 presents the option of manufacturing the accumulator from steel. Because of metal fatigue and cracking, this option was not available with respect to prior art accumulator designs. Reinforced joint 49 provides sufficient structural strength to overcome stress forces triggered by, among other things, compressor start-stop, torque, pulsations and vibrations associated with compressor operation. Due to the enhanced stress characteristics, the improved suction accumulator made from steel can pass endurance tests and is now a viable manufacturing alternative to copper.

Figure 3:
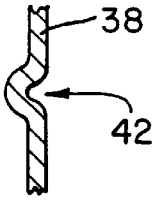
FIG. 3 is an enlarged sectional view of a portion of the inlet tube taken along line 3 of FIG. 1.
Figure 6:
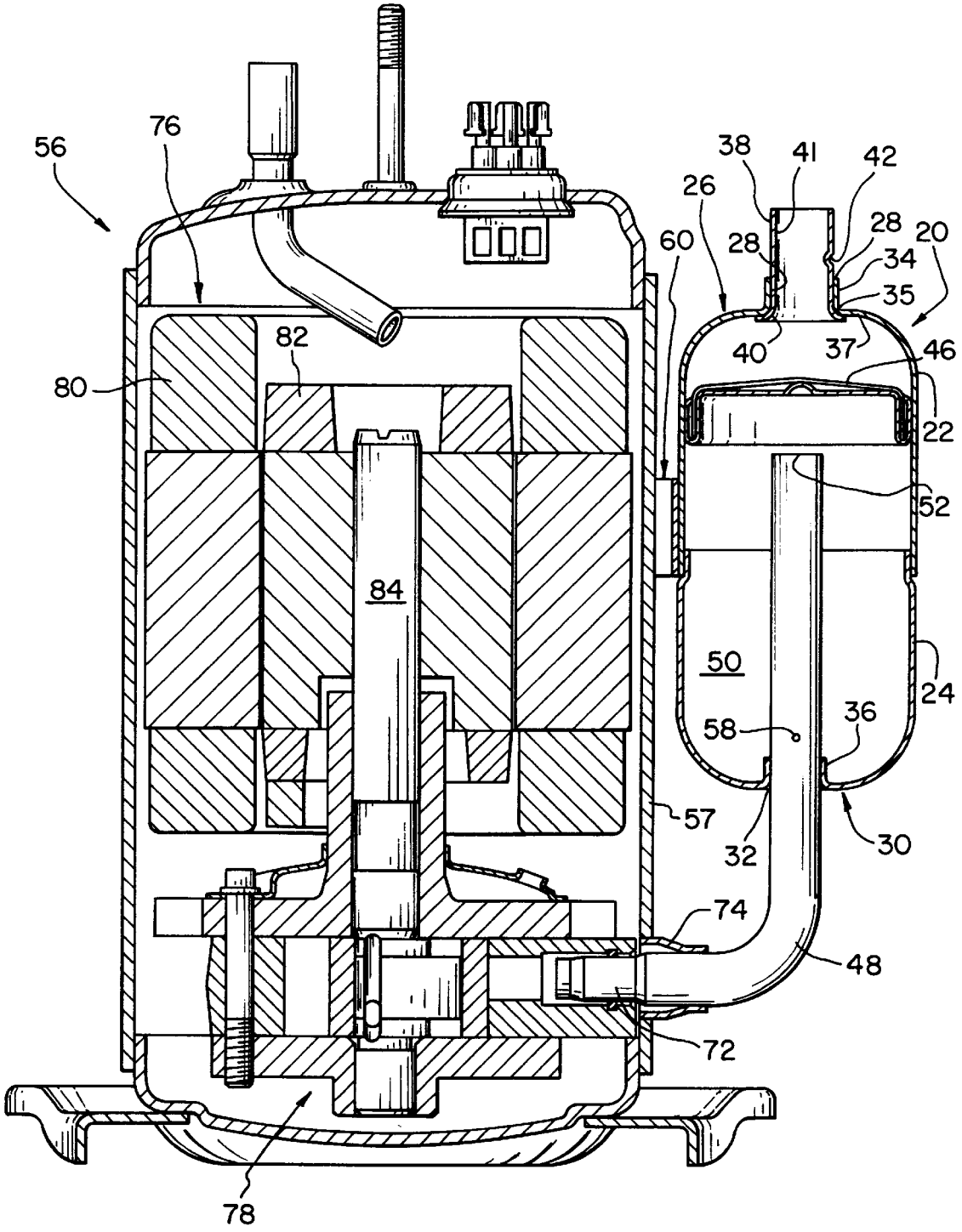
FIG. 6 is a longitudinal sectional view of the suction accumulator mounted to a compressor.

As best shown in FIGS. 3 and 6, inlet tube 28 is also provided with dimple or depression 42 which prevents excessive axial movement of evaporator output conduit 43 (FIG. 7) when inserted into tube 38. Preferably, depression 42 projects inwardly and engages the lower end of evaporator conduit 43. In other embodiments, other stop mechanisms could be employed to prevent evaporator output conduit 43 from excessively penetrating accumulator 20 and damaging accumulator screen 46.

Again referring to FIG. 1, suction tube 48 is shown disposed within accumulator outlet 32 with outlet neck 36 in concentric engagement with the circumference of suction tube 48. In the exemplary embodiment, suction tube 48 is manufactured from steel and is brazed to the accumulator at outlet 32. However, other materials having similar plasticity characteristics and other fastening techniques such as welding are possible.

Suction tube 48 substantially extends into cavity 50 of accumulator 20 such that input end 52 of suction tube 48 is disposed above the liquid refrigerant (not shown) and is therefore able to draw primarily refrigerant vapor for communication back to compressor 56 (FIG. 6). Suction tube 48 also includes bleed hole 58 disposed toward bottom domed end 30. As suction is applied, oil is aspirated through bleed hole 58 and into suction tube 48.

Referring to FIG. 1, the preferred method for assembling accumulator assembly 20 and mounting the assembly to the compressor is as follows. Inlet tube 38 is disposed in inlet 28 and is positioned so that flared end 40 abuts arcuate portion 35 of neck 34. Screen 46 is disposed in top portion 22 and is attached thereto opposite opening 28. Mounting bracket 60 is secured, such as by spot welding, to accumulator housing top portion 22. A braze ring is provided at the interface of inlet tube 38 and neck 34, inlet tube 38 is then attached, such as by welding or brazing, to neck 34 of accumulator top portion 22.

Suction tube 48 is disposed partially within lower portion 24 at outlet 32 and is attached thereto at neck 36, such as by brazing. Top portion 22 is sealably attached to lower portion 24 so as to form accumulator assembly 20. With accumulator assembly 20 complete, mounting bracket 60 is then securedly attached to outside wall 57 of compressor 56, such as by welding. In conjunction with attaching the mounting bracket to the exterior wall of the compressor, second end 72 of suction tube 48 is disposed in the compressor suction inlet and is sealably attached, such as by welding or brazing, to the compressor by adaptor 74. In this manner, the suction accumulator assembly is attached to the compressor as an integral unit, thereby reducing the time for assembling the compressor and suction accumulator assembly. It is preferred to test the accumulator assembly for leaks at some point during assembly prior to mounting accumulator assembly 20 on compressor 56.

Figure 4A:
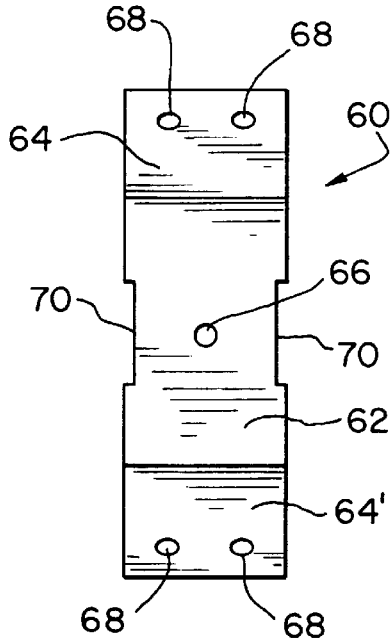
FIG. 4A is an elevational view of a first embodiment of the mounting bracket.
Figure 2:
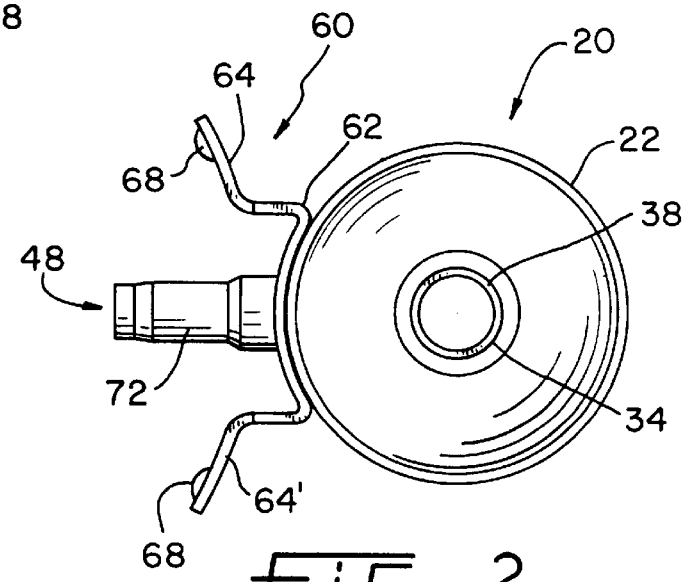
FIG. 2 is a top view of the accumulator shown in FIG. 1.
Figure 4B:
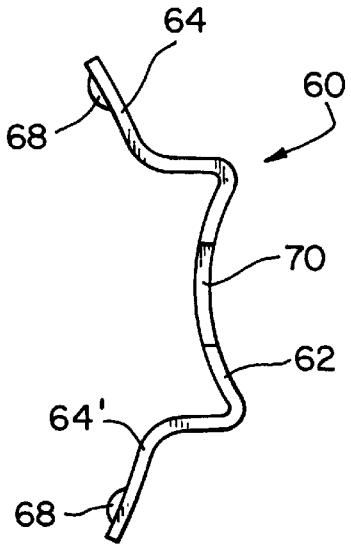
FIG. 4B is an edge view of the mounting bracket of FIG. 4A.

Referring now to FIG. 4B, mounting bracket 60 includes base 62 and extension arms 64 and 64'. As best shown in FIG. 2, base 62 is contoured to match the curvature of top portion 22 of accumulator 20. In a first exemplary embodiment, base 62 includes a welding aperture 66 (FIG. 4A) to facilitate welding of mounting bracket 60 to accumulator 20, however additional apertures or alternative fastening mechanisms are within the scope of the present invention.

As shown in FIGS. 4A and 4B, extension arms 64 and 64' each include two welding projections 68 which are used to facilitate welding of mounting bracket 60 to compressor 56. Although extension arms 64 and 64' are each shown having two welding projections 68, additional projections, or alternative fastening mechanisms are within the scope of the present invention. In the first exemplary embodiment, base 62 includes a pair of locating notches 70 which facilitate proper placement of mounting bracket 60 on accumulator 20.

Figure 5A:
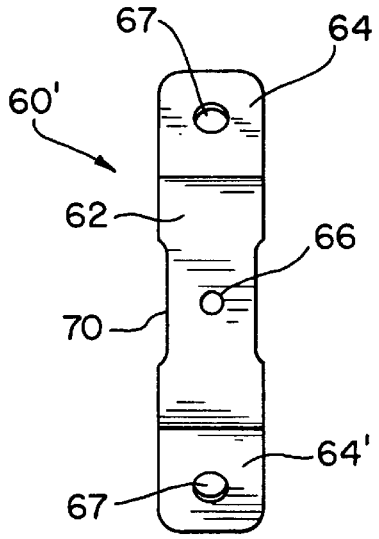
FIG. 5A is an elevational view of a second embodiment of the mounting bracket.
Figure 5B:
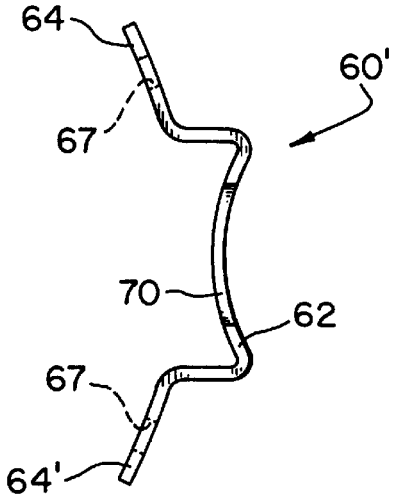
FIG. 5B is an edge view of the mounting bracket of FIG. 5A.

An alternative embodiment of the accumulator mounting bracket is illustrated in FIGS. 5A and 5B. Mounting bracket 60' is provided with extension arms 64 and 64', each having a welding aperture 67 which is used to facilitate welding of mounting bracket 60' to compressor 56. Base 62 includes a pair of locating notches 70 which facilitate proper placement of mounting bracket 60' on accumulator 20. The outermost end portions of extension arms 64 and 64' are angled slightly inward toward each other for the purpose of accommodating a slight variance with compressor 56.

All joints of the accumulator assembly are furnace brazed in a single operation. During furnace brazing, flared end 40 of inlet tube 38 is brazed to accumulator inlet 28, suction tube 48 is brazed to accumulator outlet 32, and mounting bracket 60 is brazed, in addition to the preliminary spot welding, to accumulator top portion 22, as best shown in FIG. 1. Suction accumulator 20 can then be easily attached to a compressor housing as one integral unit. End 72 of suction tube 48 is inserted into the suction opening of the compressor until weld projections 68 of mounting bracket 60 meet the outside wall of the compressor. End 72 may be connected to the compressor suction opening by means of suction inlet adapter 74. In the exemplary embodiment, weld projections 68 are then spot welded to the housing of the compressor, although other means of fastening bracket 60 to compressor 56 are fully contemplated and understood to be within the scope of the present invention. Evaporator outlet conduit 43 is then inserted into inlet tube 38 until the end of evaporator outlet conduit 43 contacts depression 42 formed in inlet tube 38 as shown in FIG. 7.

As shown in FIG. 6, suction accumulator 20 is attached to outer wall 57 of compressor 56. Compressor 56 is shown as a rotary compressor, although the present suction accumulator can be used in conjunction with other types of compressors such as reciprocating compressors. Compressor 56 is of a conventional design having motor section 76 and compressor section 78. Motor section 76 includes stator 80, rotor 82, and shaft 84 which drives compressor section 78.

It will be appreciated that the foregoing is presented by way of illustration only, and not by way of any limitation, and that various alternatives and modifications may be made to the illustrated embodiment without departing from the spirit and scope of the invention. This application is therefore intended to encompass any variations, uses, or adaptations of the invention using its general principles. Further, this application is intended to encompass such departures from the present disclosure as come within known or customary practice in the art to which this invention pertains, and which fall within the limits of the appended claims.

What is claimed is:

1. A method of manufacturing a suction accumulator and compressor assembly comprising the steps of securing a mounting bracket to the suction accumulator housing, said suction accumulator housing having an inlet and an outlet, said inlet having an inlet tube disposed therein, said outlet having a suction tube disposed therein; and then attaching said mounting bracket to the compressor, said mounting bracket, said suction accumulator housing, said inlet tube, and said suction tube attaching to the compressor as one unit to thereby reduce the assembly time for the compressor and suction accumulator assembly.

2. The method of claim 1 wherein said securing step and said attaching step are performed by welding.

3. The method of claim 1 further including the step of inserting a conduit into said accumulator inlet tube until said conduit engages an inwardly directed stop member provided in said accumulator inlet tube, said stop member preventing said conduit from extending too far and damaging the interior of said suction accumulator.

4. The method of claim 1 further including the step of sealably connecting a conduit with said accumulator inlet tube until said conduit engages a stop member provided on said accumulator, said stop member limiting axial movement of said conduit toward said accumulator.

5. A method of mounting a suction accumulator assembly to a refrigeration compressor having an outer wall and a suction inlet therethrough, the suction accumulator assembly having a housing, a mounting bracket, an inlet tube, and a suction tube, said mounting method comprising the steps of:

disposing a free end of the suction tube in the suction inlet;

then securing the mounting bracket to the compressor outer wall; and sealably attaching the suction tube to the compressor, whereby the suction accumulator assembly is attached to the compressor as one unit to thereby reduce the time for assembling the compressor and suction accumulator assembly.

6. The method of claim 5 further including the step of sealably connecting a conduit with the inlet tube by inserting the conduit telescopingly within the inlet tube until the conduit engages a stop provided on the inlet tube, the stop limiting the telescopic movement of the conduit toward the suction accumulator assembly.

* * * * *

UNITED STATES PATENT AND TRADEMARK OFFICE

CERTIFICATE OF CORRECTION

PATENT NO. : 6,092,284
DATED : August 29, 2000
INVENTOR(S) : Nelik I. Dreiman, Rick L. Bunch, Tara C. Kandpal It is certified that error appears in the above-identified patent and that said Letters Patent is hereby corrected as shown below:

Claim 6, column 8,
Line 24, delete "inserting the conduit telescopingly within the" and substitute therefor -- telescopically engaging the conduit and the --
Line 27, delete "movement" and substitute therefor -- engagement --

Signed and Sealed this

Eighteenth Day of September, 2001

*Attest:*

Nicholas P. Godici

*Attesting Officer*

NICHOLAS P. GODICI
*Acting Director of the United States Patent and Trademark Office*